US006105254A

United States Patent [19]

Crane et al.

[11] Patent Number: 6,105,254

[45] Date of Patent: Aug. 22, 2000

[54] ARTICULATING SPOON

[75] Inventors: John A. Crane; Cyril Crane, both of Downers Grove, Ill.

[73] Assignee: JAC Investments, Inc., Elk Grove Village, Ill.

[21] Appl. No.: 09/046,026

[22] Filed: Mar. 23, 1998

[51] Int. Cl.[7] ..... A47J 43/28

[52] U.S. Cl. ..... 30/128; 30/324; 30/326

[58] Field of Search ..... 30/128, 142, 147, 30/149, 150, 324, 325, 326, 327, 328; D7/656, 657

[56] References Cited

U.S. PATENT DOCUMENTS

| | | | |
|---|---|---|---|
| 510,286 | 12/1893 | Osterman | 30/128 |
| 820,061 | 5/1906 | Mosteller | 30/128 X |
| 880,190 | 2/1908 | Von Bultzingslowen | 30/326 X |
| 1,742,232 | 1/1930 | Casale | 30/150 X |
| 1,980,477 | 11/1934 | Ertola et al. | 30/128 X |
| 2,561,374 | 7/1951 | Igoe | 30/324 |
| 2,563,521 | 8/1951 | Ferriot | 30/254 |
| 2,698,996 | 1/1955 | Hickerson | 30/123 |
| 2,787,055 | 4/1957 | Wertz | 30/123 |
| 2,833,084 | 5/1958 | Hlousek | 446/72 |
| 2,887,948 | 5/1959 | Kramer et al. | 30/325 X |
| 4,521,964 | 6/1985 | Maruyama | 30/149 X |
| 4,779,344 | 10/1988 | Panisch | 30/326 |
| 5,193,808 | 3/1993 | Takeshi | 273/138 R |
| 5,491,897 | 2/1996 | Michelena | 30/324 X |
| 5,655,303 | 8/1997 | Janczak | 30/324 X |

FOREIGN PATENT DOCUMENTS

| | | | |
|---|---|---|---|
| 452336 | 11/1927 | Germany | 30/128 |
| 26383 | of 1907 | United Kingdom | 30/128 |

*Primary Examiner*—Kenneth E. Peterson
*Attorney, Agent, or Firm*—Knechtel, Demeur & Samlan

[57] ABSTRACT

A hand held eating utensil having a pair of scissors like handles pivotally connected to each other at approximately their midpoints. A spoon bowl is at the forward end of one of the handles and a pusher mechanism shaped as an animal head is pivotally connected to the forward end of the other handle. As the rear ends of the handles are moved toward each other, the forward portion of the animal head dips down into the spoon bowl and pushes the food contents in the bowl forward out of the bowl. The animal head pivots downward when the handles are spread apart to minimize the chance of a child poking himself with the front end of the animal head.

16 Claims, 2 Drawing Sheets

ARTICULATING SPOON

I. BACKGROUND AND SUMMARY OF THE INVENTION

The present invention relates to the design and construction of hand held eating utensils, and, more particularly, to a spoon having an ornamental design or figure as a part of the spoon for the amusement of children.

Often children need encouragement to eat certain foods or at times merely want to experience a more pleasurable eating experience during meal time. At other times, children merely like to have small toys which can be related to food items as a source of amusement.

Also, food manufacturers often desire small items to be placed in cereal or candy boxes as promotional items. Such items must be designed so that they can be packaged in a flat configuration, must be inexpensively manufactured, and must be safe in the hands of children. Furthermore, such products may have to meet stringent requirements for food applications. It is also advantageous if such items are easily modified to provide for several different types of utensils without changing the overall design concept of the product.

In the past, various types of children's utensils have been developed. For instance, U.S. Pat. No. 2,787,055 entitled "Articulated Toy and Spoon for Hand Feeding an Infant" discloses an articulated toy spoon which protrudes through a face of a cartoon like character. The idea of this device is to take the child's mind off eating and have the child's attention directed toward the cartoon like face through which the spoon protrudes.

In U.S. Pat. No. 2,833,084 entitled "Attachment for Child's Eating Utensil" there is disclosed an ornamental attachment to the handle of the spoon which, again, will draw the child's attention to the ornamental handle rather than the food in the bowl of the spoon. U.S. Pat. No. 2,561,374 entitled "Kitchen Spoon Tongs" illustrates a pair of spoons which are mounted about a pivot point so that the spoons can close around the food to be served. However, there is not any decorative means which would be particularly amusing to a child.

U.S. Pat. No. 510,286 entitled "Spoon" illustrates a spoon which has a pusher/scraper mechanism which conforms to the curvature of the spoon bowl. The scraper operates by pushing it forward along the spoon bowl such that any food in the bowl will be pushed out the front of the bowl. The scraper is operated by merely pushing it from its end opposite the scraper end. There is again no ornamental designs on the spoon which would be attractive or amusing to children.

U.S. Pat. No. 4,779,344 entitled "Manipulatable Utensil Figure" illustrates another spoon having a figure at the end opposite the spoon bowl. The figure can be operated by placing a finger within the figure to manipulate it. There is not any means illustrated to push or scrape the food off or out of the spoon bowl.

As can be seen from the prior devices, there has never been disclosed a spoon having a configuration which operates in a scissors like manner and also has an ornamental or decorative animal head at the bowl end of the device. The prior art had imaginative decorative figures which were attached to the handle portion of the spoon, but not at the bowl end of the spoon. Furthermore, none of the prior art devices disclosed a pusher mechanism configured in a cartoon or animal like figure. Furthermore, none of the prior art devices dealt with a pusher mechanism which will push the food off the spoon as the handles of the scissors like device are operated toward each other.

Accordingly, applicant's invention provides a hand held eating utensil in the general configuration of a scissors and spoon. A pair of scissors like handles are connected to each other at approximately their mid points. The spoon bowl is attached to the forward end of one of the handles. A pusher mechanism shaped like an animal head is pivotally connected to the forward end of the other handle. The animal head has a forward most portion or snout which conforms to the inside of the bowl of the spoon. As the rear or distal ends of the handles are moved toward each other, the forward ends of the handles similarly move toward each other. The snout or forward portion of the animal head dips down into the bowl and pushes any food contents in the bowl forward out of the bowl. Thus, the closure of the handles causes food to be pushed out of the spoon into the child's mouth. The pivotal connection of the head causes the head to drop down and minimizes the likelihood that a child will poke himself or someone else in the eye with the snout of the animal head. Furthermore, the eating utensil can be injection molded out of food safe plastic materials in a relatively inexpensive molding process. Also, the pieces can be individually molded and adapted for snapping together. In this manner, the pieces can be stored flat in the cereal or candy box for easy packing and distribution.

Accordingly, a primary object of the present invention is to provide a novel construction of an eating utensil which construction allows for the interaction of the user with the decorative and functional animal figures of the spoon.

Another object of the invention is to provide a spoon having an articulated pushing portion which causes the food in the bowl of the spoon to be pushed out into the user's mouth. Related thereto is the object of providing a spoon having a pair of spoon handles pivotally connected to each other such that operating the spoon handles toward each other causes the articulated animal head to push the food in the spoon bowl out of the spoon bowl. Another object is to provide an easily and inexpensively manufactured spoon which is safe for food products.

Still another object is the object of providing a spoon made of several spoon parts which can be packaged in a flat configuration and easily assembled by the user.

Still another object is the object of providing a spoon having a pivotal animal head which pivots into a safe orientation such that the user will not be likely to poke himself or another child in the eye with the pusher animal head.

A further object is to provide an attractive eating utensil design which induces the child to eat his food and still provide an amusing device for the child to play with either with or without any food thereon.

Other objects and advantages of the present invention will become more apparent to persons having ordinary skill in the art to which the present invention pertains from the following description taken in conjunction with the accompanying drawings.

II. BRIEF DESCRIPTION OF THE DRAWINGS

III. DETAILED DESCRIPTION OF THE PREFERRED EMBODIMENT

Figure 1:
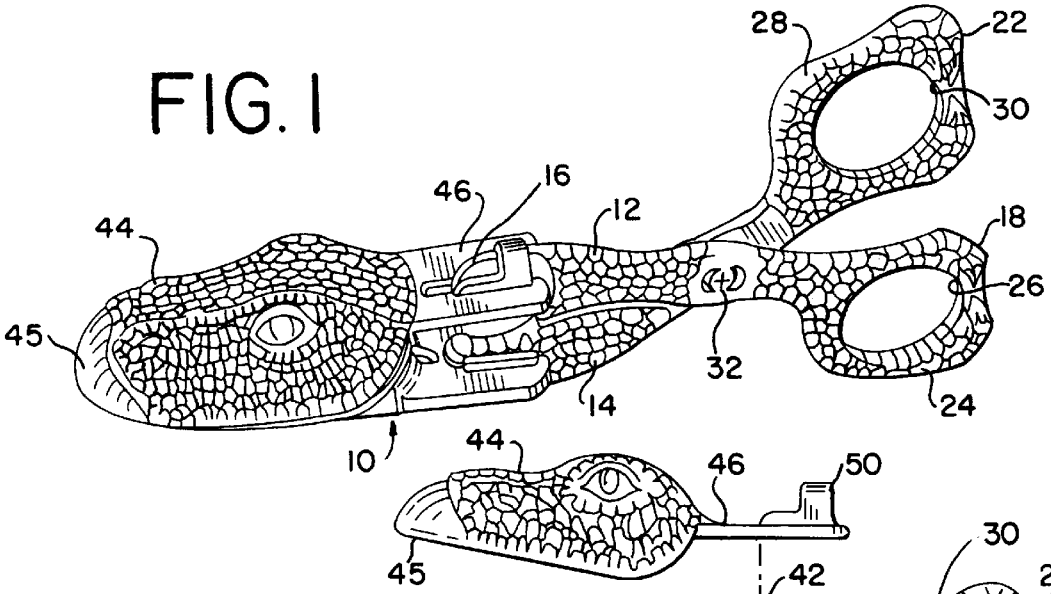
FIG. 1 is a perspective view of applicant's invention showing the spoon with the decorative animal head in a closed position covering the spoon's bowl.

Turning first to FIG. 1, there is illustrated an eating utensil, and more particularly shown as an articulating spoon 10. The spoon 10 is comprised of a pair of handles, namely, a head handle 12 and spoon handle 14. The head handle 12 has proximal and distal ends 16 and 18 respectively. The spoon handle 14 also has proximal and distal ends 20 and 22 respectively. The distal end 18 of the head handle 12 terminates in a finger handle 24 which has formed therein a finger loop 26. The spoon handle 14 terminates at its distal end 22 at a thumb handle 28 forming a thumb loop 30. The two handles are joined at approximately their mid points by a pivot pin 32. The pivot pin 32 can be integrally molded in one of the handles with the other handle having a pin receiving hole. Alternative, a hole can pass through both of the handles with a rivet type assembly passing therethrough in order to hold the handles together, yet allow them to rotate with respect to each other around the pivot pin 32.

Figure 2:
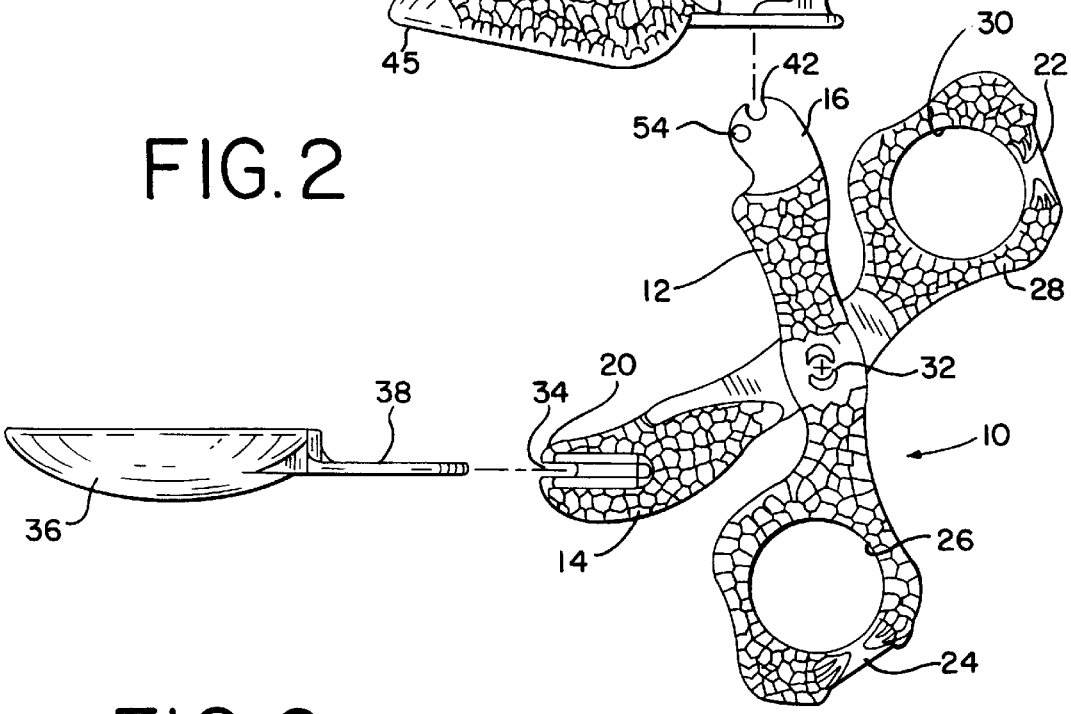
FIG. 2 is a side elevational view with portions exploded showing the spoon in the open position with the animal head and bowl removed from the spoon handles.

Turning to FIG. 2, the component parts of the spoon 10 are more clearly illustrated. At the proximal end 20 of the spoon handle 14 is a groove 34. A bowl 36 has a neck 38 which has a spoon channel 40 at the end opposite the bowl 36. The spoon channel 40 receives the groove 34 of the spoon handle 14. Thus, the bowl 36 can be manufactured separately from the spoon handle 14 yet easily assembled by merely sliding the spoon channel 40 into the groove 34. Alternatively, the spoon handle 14 can be injection molded integrally with the bowl 36.

Figure 6:
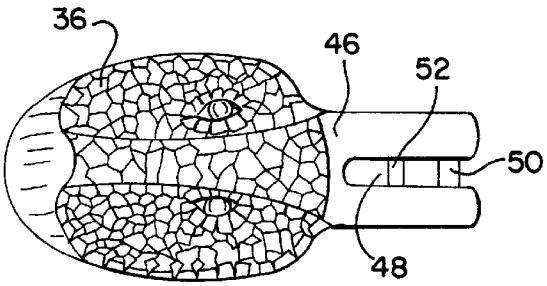
FIG. 6 is a top plan view of the animal head showing the pivotal connecting mechanism.
Figure 7:
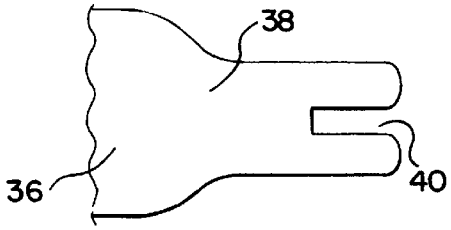
FIG. 7 is a top plan view with portions removed of the spoon bowl showing how it attaches to the handle.

The other handle and its components are also illustrated in FIG. 2. At the proximal end 16 of the head handle 12 is a semicircular recess 42. A pusher head 44 is configured in the shape of an animal head such as a dinosaur, reptile, or any other animal imaginable. It has a forward portion or snout 45. At the end of the head opposite the forward portion 45 is a neck 46 (see FIG. 6). Longitudinally cut in the neck 46 is a channel 48. Bridging the two sides of the channel 48 and extending above the neck 46 is a collar 50. A pivot bar 52 also extends across the two sides of the channel 48. The pivot bar 52 is pushed down into the semicircular recess 42 in the proximal end 16 of head handle 12 and snaps therein. The diameter of the semicircular recess is slightly greater than the diameter of the pivot bar 52 so that the pusher head 44 is allowed to rotate about the pivot bar 52. A stop pin 54 is molded into the proximal end 16 of the head handle 12 as will be more fully described herein.

Figure 4:
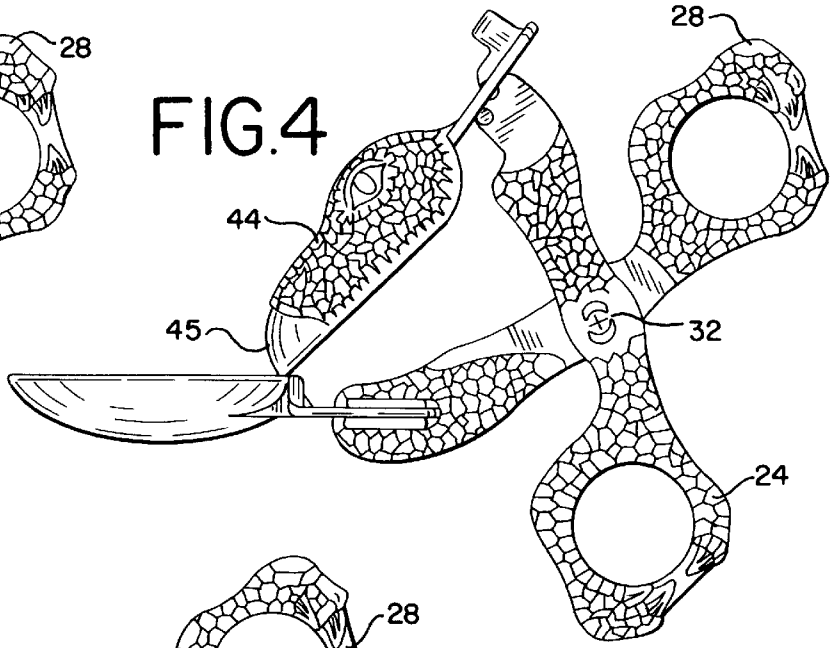
FIG. 4 is a side elevational view of the spoon of FIG. 3 with the handles beginning their movement toward each other and the pusher head engaging the spoon bowl.
Figure 3:
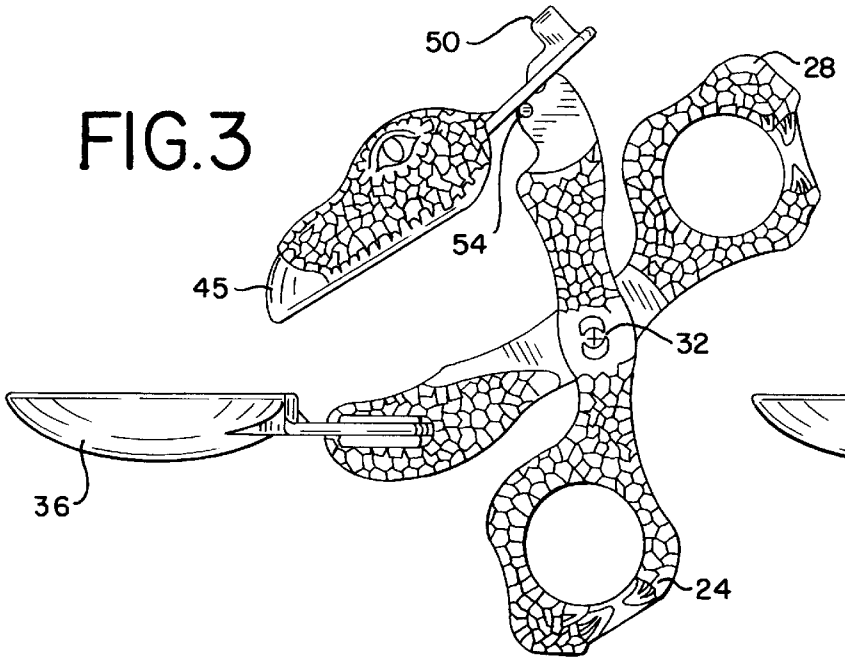
FIG. 3 is a side elevational view of the spoon of FIG. 2 showing the bowl and animal head in its assembled position, the handles spread apart, with the animal head pivoted downward.
Figure 5:
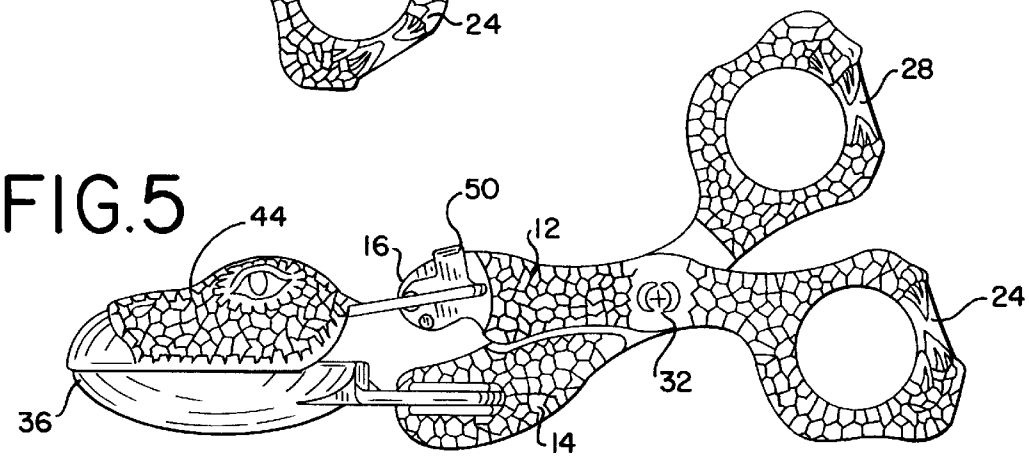
FIG. 5 is a side elevational view showing the handles in their closed position with the animal head resting on top of the spoon bowl.

Turning to FIGS. 3–5, the operation of the spoon can be more clearly described. The operator places his thumb in the thumb loop 30 and the index finger in the finger loop 26. He then spreads the handles apart so that they assume the position shown in FIG. 3. This is similar to operating a scissors in which the scissors blades are separated. The pusher head 44 will drop down due to the fact that pivot bar 52 (which is the point of pivot) is located closer to the rear of the pusher head than to the forward portion 45. The head thus pivots downward and is kept from rotating completely to the head handle 12 by the stop pin 54. With the head in this dropped configuration, it provides a measure of safety from a child poking himself or another person in the eye with the forward portion 45. Furthermore, this provides a blunt surface, rather than the pointed snout 45, facing the child. Food can be placed in the bowl 36 while in this position.

The thumb handle and finger handle 28 and 24 respectively are then squeezed and moved toward each other. The forward portion 45 of the pusher head 44 engages the rear of the bowl 36 and begins pushing the food forward. The forward portion 45 is dimensioned to approximate the inside contour of the bowl 36. Thus, the food is scraped off the bottom of the bowl and pushed forward.

The thumb handle 28 and finger handle 24 continue to be squeezed toward each other causing the forward portion 45 to continue moving across the inside of the bowl 36. The food is pushed forward out of the bowl 36 and the pusher head 44 comes to rest on top of the bowl 36. The collar 50 engages the top portion of the head handle 12 which restricts rotation of the pusher head 44 any further than the position shown in FIG. 5. It further keeps the thumb handle 28 and finger handle 24 from moving any closer together than that which is shown in FIG. 5 which causes the two handles to be slightly separated.

It is recommended that the individual components be injected molded from a food grade plastic material. Furthermore, the plastic material should not be made of a plastic that is easily chipped or broken, due to the fact that children will be biting on the bowl, and the plastic components must have resiliency. The bowl 36, pusher head 44, head handle 12 and spoon handle 14 can each be injected molded as a separate component. The four components are then snapped together to form the finished product. The handles can be textured to resemble the skin of a reptile or other animal. The head 44 can be formed in any imaginable animal shape or cartoon character.

Thus, there has been provided an articulating spoon that fully satisfies the objects, aims and advantages. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

We claim:

1. A hand held eating utensil comprising.

a first and second elongated handle pivotally connected at a pivot point to each other along their lengths, the first and second elongated handles having proximal and distal ends, each elongated handle terminating at its distal end in a loop, the loops adapted to be grasped by a finger and a thumb of a user of the utensil, a spoon having a bowl at the proximal end of the first handle, the bowl having two ends with one end attached to the proximal end of the first handle, a pusher member pivotally connected to the proximal end of the second handle for pushing the pusher member across the spoon's bowl from the one end of the bowl attached to the proximal end of the first handle to the other end of the bowl when the distal ends of the handles are moved toward each other.

2. The eating utensil of claim 1 wherein the pusher member has a forward end configured to be closely received within the bowl as the pusher member pushes across the bowl.

3. The eating utensil of claim 2 wherein the pusher member is pivotally connected to the second handle by means of a pivotal hinge connection which permits the pusher member to pivot about the pivotal hinge connection as the distal ends of the handles are moved toward and away from each other.

4. The eating utensil of claim 3 and further comprising stop means on the pusher member for limiting the amount that the pusher member can pivot in a first angular direction about the pivotal hinge connection.

5. The eating utensil of claim 4 and further comprising second stop means on the proximal end of the second handle for limiting the amount that the pusher member can pivot in a second angular direction opposite the first angular direction about the pivotal hinge connection.

6. The eating utensil of claim 5 wherein the second stop means comprises a stop pin on the forward end of the second handle, the pusher member engaging the stop pin as the pusher member pivots about the pivotal hinge connection, the stop pin restricting the rotation of the pusher member as the distal ends of the two handles are moved away from each other.

7. The eating utensil of claim 4 wherein the stop means on the pusher member comprises a collar member on the pusher member which encircles a portion of the proximal end of the second handle, the collar member engaging the encircled portion of the proximal end of the second handle thereby restricting the pivoting of the pusher member.

8. The eating utensil of claim 3 wherein the pusher member is configured as an animal head.

9. The eating utensil of claim 3 wherein the forward end of the pusher member moves forward away from the distal end of the second handle as the distal ends of the second handle and the first handle are moved toward each other.

10. The eating utensil of claim 3 wherein the forward end of the pusher member pivots in a downward direction toward the first handle as the distal ends of the first handle and the second handle are moved away from each other.

11. The eating utensil of claim 1 wherein the spoon and pusher member are formed as separate pieces and are removable from their respective handles.

12. The eating utensil of claim 11 wherein the spoon has a channel formed therein and the first handle has a slot which receives the channel in the spoon to fasten the spoon to the first handle.

13. A hand held eating utensil comprising:

a pair of handles pivotally connected to each other along their lengths by a pivot connection, each of said handles having proximal and distal ends, a finger receiving loop at the distal end of one of the handles and a thumb receiving loop at the distal end of the other handle;

a spoon having a bowl at the proximal end of the other handle, an animal shaped pusher head having a forward snout and a rear neck pivotally connected at the rear neck by a pivotal hinge to the proximal end of the one handle which permits the pusher head to pivot about the pivotal hinge as the distal ends of the handles are moved toward and away from each other;

the pusher head covering the bowl when the distal ends of the handles are positioned adjacent to each other in a closed orientation and the pusher head assuming a raised position exposing the bowl when the distal ends of the handles are positioned apart from each other in an opened orientation.

14. The hand held eating utensil of claim 13 wherein the pivotal hinge is connected to the pusher head at a location on the pusher head whereby the center of gravity of the usher head causes the snout of the pusher head to rotate downward when the distal ends of the handles are separated.

15. The hand held utensil of claim 14 wherein the snout of the pusher head dips down and forward into the bowl as the distal ends of the handles are moved toward each other.

16. The hand held utensil of claim 15 and further comprising stop means for limiting the amount that the pusher head can pivot about the pivotal hinge.

* * * * *

UNITED STATES PATENT AND TRADEMARK OFFICE

CERTIFICATE OF CORRECTION

PATENT NO. : 6,105,254

DATED : Aug. 22, 2000

INVENTOR(S) : Crane et al.

It is certified that error appears in the above-identified patent and that said Letters Patent is hereby corrected as shown below:

IN THE CLAIMS:

Claim 14, Line 3, change the word "usher" to --pusher--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*